United States Patent [19]

Le Bras

[11] Patent Number: 4,848,061

[45] Date of Patent: Jul. 18, 1989

[54] APPLICATOR MECHANISM AND METHOD FOR APPLYING CARRIER CARTONS TO GROUPED ARTICLES

[75] Inventor: Philippe Le Bras, Chateauroux, France

[73] Assignee: The Mead Corporation, Dayton, Ohio

[21] Appl. No.: 161,701

[22] Filed: Feb. 29, 1988

[30] Foreign Application Priority Data

Mar. 21, 1987 [GB] United Kingdom ..... 8706776

[51] Int. Cl.[4] ..... B65B 27/04; B65B 43/12; B65B 43/26

[52] U.S. Cl. ..... 53/398; 53/49; 53/457; 53/564

[58] Field of Search ..... 53/48, 49, 307, 291, 53/295, 398, 458, 564, 566, 573, 457; 493/313, 315, 316, 317, 318

[56] References Cited

U.S. PATENT DOCUMENTS

| | | | |
|---|---|---|---|
| 3,303,631 | 2/1967 | Ganz | 53/48 |
| 3,477,199 | 11/1969 | Keas | 53/307 |
| 3,492,778 | 2/1970 | Focke | 53/49 |
| 3,848,519 | 11/1974 | Ganz | 53/48 X |
| 3,991,660 | 11/1976 | Calvert et al. | 493/316 |
| 4,213,283 | 7/1980 | Calvert et al. | 53/48 |
| 4,340,380 | 7/1982 | Calvert | 493/316 |
| 4,512,756 | 4/1985 | Fields | 493/316 X |
| 4,703,607 | 11/1987 | Pröpper et al. | 53/307 |

FOREIGN PATENT DOCUMENTS

| | | | |
|---|---|---|---|
| 1427510 | 2/1976 | United Kingdom | 53/48 |

*Primary Examiner*—Robert L. Spruill
*Assistant Examiner*—Beth Bianca
*Attorney, Agent, or Firm*—Erwin Doerr

[57] ABSTRACT

A mechanism (10) and method for applying a top gripping type carrier carton onto the tops of a group of bottles (B) disposed within a crate comprises a carton transfer unit (34) for withdrawing a carton (c) from a supply (H) and transferring a carton from the supply to a position of application, a carton manipulating device (36) for at least partially erecting the carton during transfer, a pivotal arm (12) being provided for pivoting the transfer unit and the manipulating device together with the carton so that the carton is inverted during transfer into an attitude correct for applying it to the bottle group.

8 Claims, 6 Drawing Sheets

APPLICATOR MECHANISM AND METHOD FOR APPLYING CARRIER CARTONS TO GROUPED ARTICLES

Figure 1A:
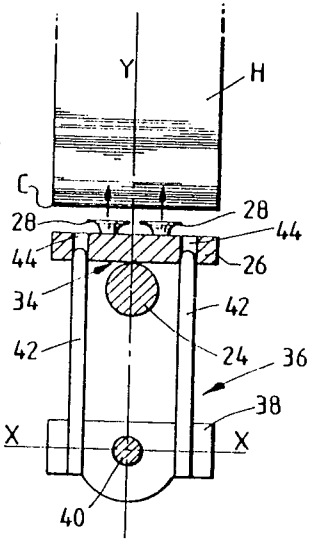

This invention relates to an applicator mechanism and method for simultaneously applying a plurality of so-called top-gripping type of carriers onto a number of articles arranged in a group. The invention is particularly suitable for applying top gripping carriers to bottles which are accommodated in a crate so that several multi-bottle packages are formed within the crate whereafter individual packages may be grasped and removed from the crate. The applicator device which comprises a reciprocal head is, but need not be, adapted to receive known top gripping carriers.

A known applicator for applying a paperboard top gripping type of carrier onto grouped bottles is disclosed in EP O 150 944 in which an applicator device utilises the natural resilience of the paperboard carrier, which tends to return the carrier to a non-erected condition, to hold the carrier against an arresting lip of the applicator from which it is released during loading by being displaced by the bottle necks introduced into the carrier. Whereas this prior device is operative, it does involve a succession of operations, each being accomplished by separate mechanical elements. The present invention seeks to simplify this type of operation and utilizes a set of cooperating elements to withdraw a carton from a hopper, open the carton while it is being transferred to a position in which it is aligned for application and effecting the application of the carton at the end of the transfer stage.

U.S. Pat. No. 4,611,454 discloses a capping machine which puts caps or covers on vessels immediately after they are filled and in which a cap is withdrawn from a supply and transferred to a position of application during which transfer the cap is inverted. However, there is no disclosure of or requirement for manipulating the cap beyond the transfer movement as in the present invention where it is necessary to open the carton into a set-up condition during transfer.

One aspect of the present invention provides a method of applying a top gripping type carrier onto the tops of a group of articles, such as bottles, comprises the steps of withdrawing a carrier from a supply causing the carrier to be transferred from the position of supply to a position from which it can readily be applied to the article group and thereafter applying said carrier, characterised in that the carrier is inverted and at least partially erected into a condition for application during said transfer operation.

Another aspect of the present invention provides a mechanism for applying a top gripping type carrier carton onto the tops of a group of articles, such as bottles, which mechanism comprises a carton transfer unit for withdrawing a carton from a supply and transferring a carton from the said supply to a position of application, a carton manipulating device for at least partially erecting the carton during said transfer, means being provided for pivoting said carton transfer unit so that the carton is inverted during transfer.

Figure 1:
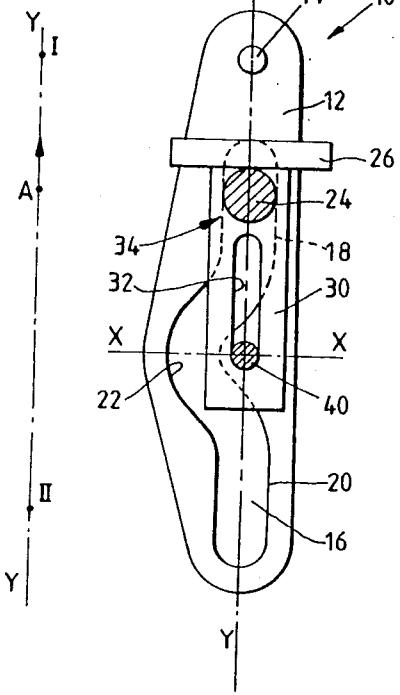
Figure 4A:
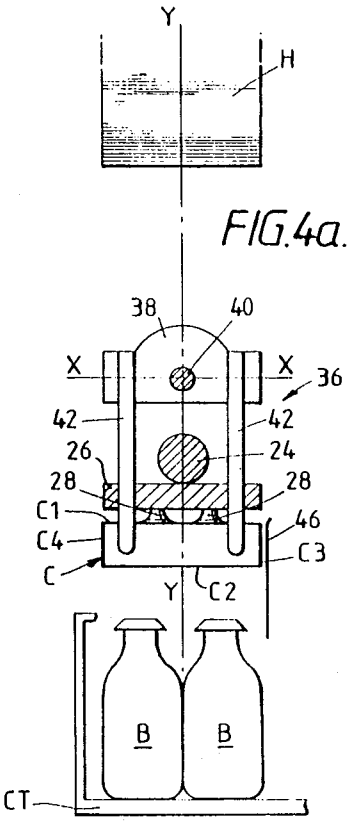
Figure 4:
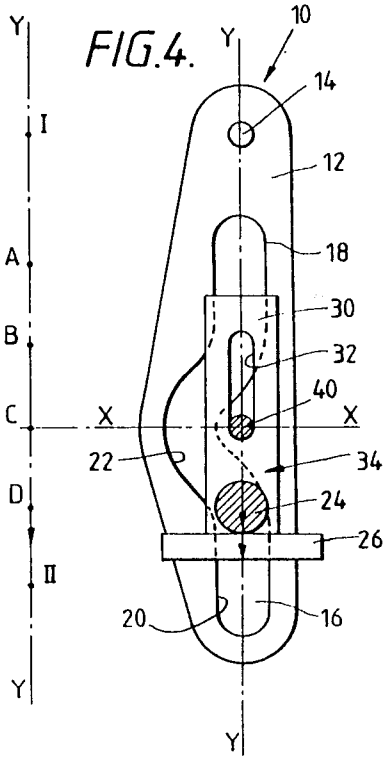
Figure 5A:
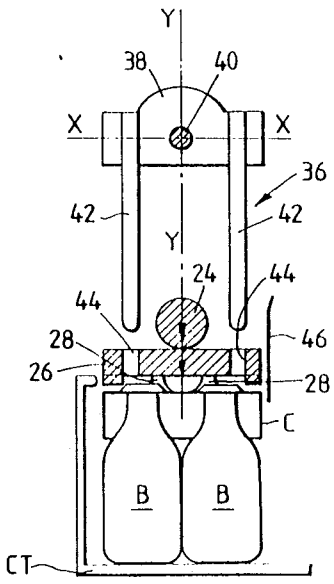
Figure 5:
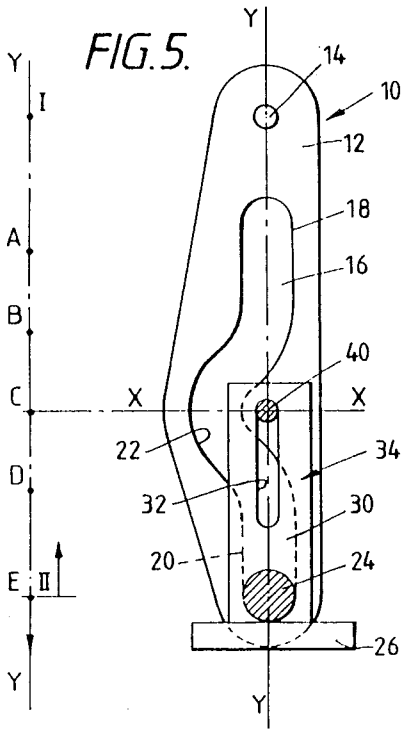
Figure 6:
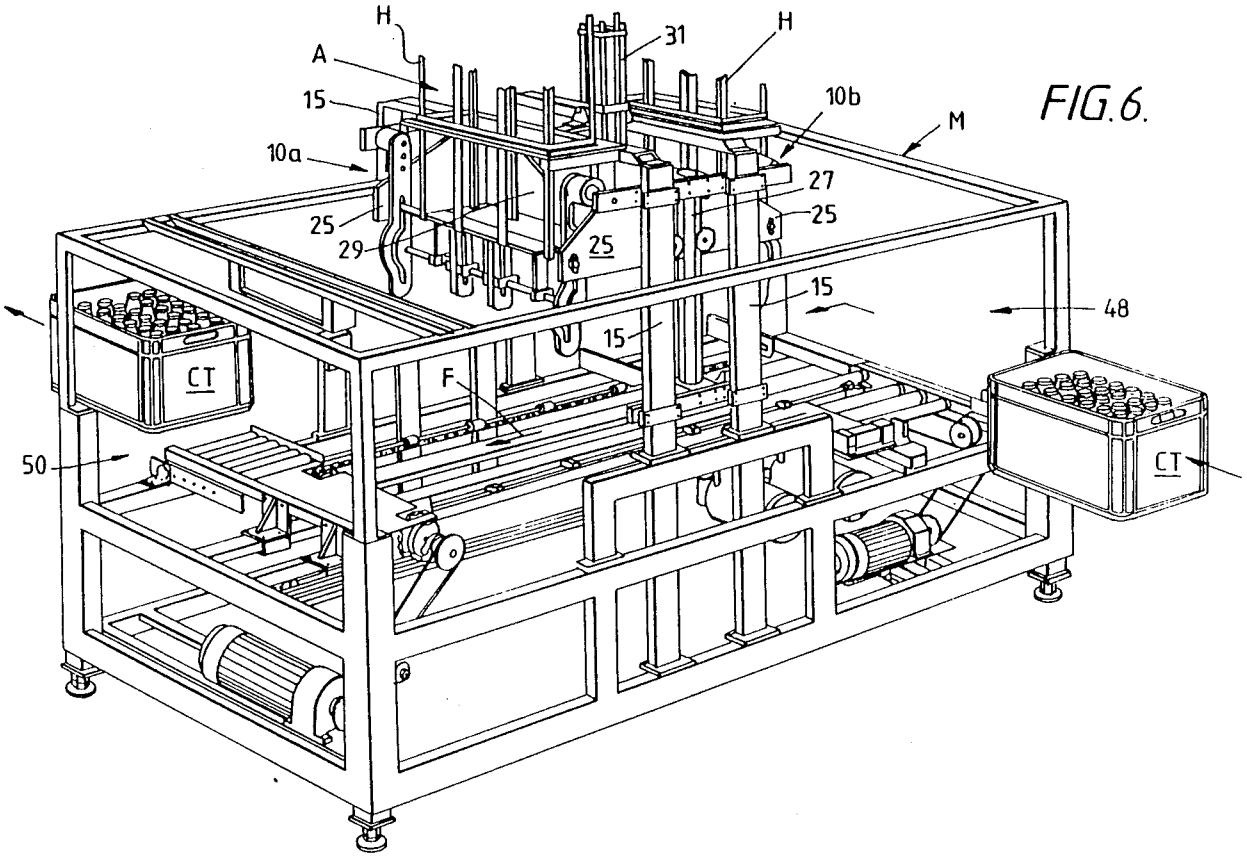

A mechanism embodying the invention will now be described by way of example with reference to the accompanying drawings, in which:

FIGS. 1 and 1*a* are schematic side views of the main components of the mechanism shown in positions in which a carrier carton is about to be withdrawn from an overhead hopper;

FIGS. 2, 2*a*, 3, 3*a*, 4, 4*a*, 5 and 5*a* are views similar to FIG. 1 but showing a sequence of operations effected by the mechanism in order to apply the carton to the necks of a group of bottles; and FIG. 6 is a general perspective view of a machine incorporating the mechanism.

The mechanism 10 comprises an elongate arm 12 which is suspended by and pivotally connected to static shaft 14. The arm 12 is mounted on shaft 14 adjacent its upper end and shaft 14 is fixed to a side post 15 forming a part of the machine frame (FIG. 6). The arm is provided with a cranked cam track 16 which is formed by a slot extending longitudinally of the arm. The slot includes an upper linear portion 18 aligned with the main longitudinal axis Y—Y of the arm, a lower linear portion 20 also aligned with axis Y—Y and a curvilinear portion 22 interconnecting the two linear portions 18 and 20.

Arm 12 cooperates with a shaft 24 which is movable longitudinally of the arm and is guided by the cam track to impart pivotal movement of arm 12 about shaft 14. Shaft 24 carries a flat transverse plate 26 which is furnished with a plurality of suction cups 28 (FIG. 1*a*) connected to a suitable vacuum source (not shown).

A longitudinal leg 30 also fixed to shaft 24 extends downwardly from one side face of the transverse plate 26 and is formed with a linear slot 32 which lies along axis 'Y—Y' when the leg is upright as shown in FIG. 1. The shaft 24, plate 26 and leg 30 together form a carton transfer unit 34 of the mechanism. Each end of shaft 24 is fixed to a side plate 25 which is guided adjacent the associated side post 15 for vertical movement along an upstanding guide 27. The opposed side plates 25 are connected by transverse members 29 to a common pneumatic ram 31 which imparts vertical movement to the side plate and hence the shaft 24 along axis Y—Y. The carton transfer unit 34 cooperates with a carton manipulating device 36 in order to ensure that the carton is transferred ready for application in a correctly set-up condition. The device 36 comprises a pair of similar finger blocks 38 fixed in spaced side by side relationship to shaft 40, to one side of the longitudinal leg 30 and beneath transverse plate 26. Shaft 40 has one of its ends fixed to arm 1 at a point which is aligned with the central position of the curvilinear portion 22 of cam track 16. Shaft 40 extends through slot 32 in longitudinal leg 30 and its other end is fixed in a like location to an arm similar to arm 12 pivoted to another side post 15 at the opposite side of the machine.

Thus shaft 40 is maintained at substantially the same position on axis X—X except when the arm 12 pivots about shaft 14 so shifting the shaft 40 slightly upwardly.

Each of the finger blocks 38 have a pair of carton opening fingers 42 which pass through apertures 44 formed in transverse plate 26 when shaft 24 is intermediate its extremities.

In FIGS. 1 and 1*a* (Phase A), shaft 24 is shown approaching the limit of its upper extremity in linear portion 18 of cam track 16 driving the unit 34 upwardly. The vacuum cups 28 of transverse plate are approaching the lowermost carton 'c' in the overhead carton supply hopper H. Also, at this relative position between the unit 34 and device 36, the fingers 42 are about to be withdrawn from the registering apertures 44. When this occurs the suction cups 28 are brought into abutment with carton 'c' and vacuum applied. Unit 34 then begins a downward travel.

Figure 2A:
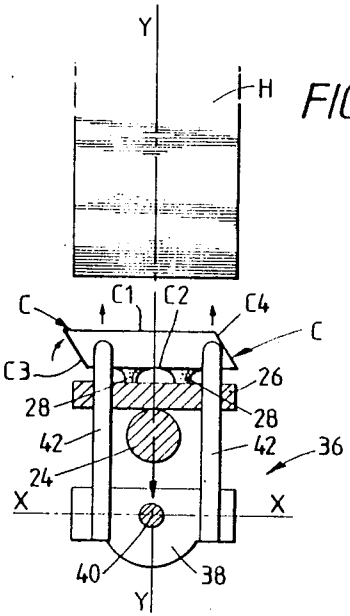
Figure 2:
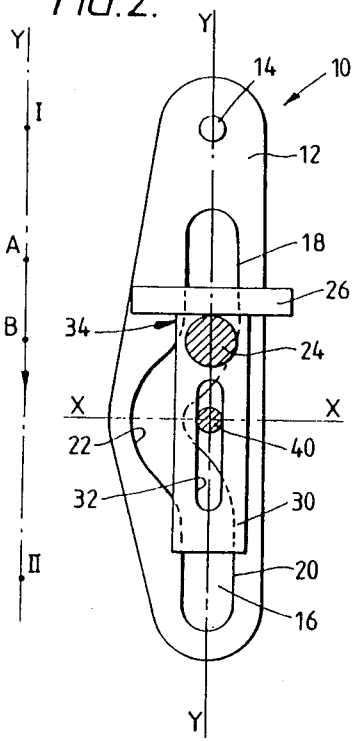

In FIGS. 2 and 2*a* (Phase B), unit 34 is travelling downwards relative to arm 12 and shaft 24 has reached the position in the cam track at which it is about to enter the curvilinear portion 22 of the track. As shown in FIG. 2*a*, the carton opening fingers 42 have passed through the transverse plate 26 and have entered carton 'c' which has been withdrawn from the overhead hopper H and held by the vacuum cups 28. Carton 'c' is a so-called top gripping type carton which is applied to the neck portions of a group (usually four) bottles to form a retail unit. Carton 'c' comprises a sleeve having a top panel C1, a parallel bottom panel C2 spaced apart by side walls C3 and C4. In the overhead supply hopper, the cartons are stacked in flat collapsed condition so that in each carton top panel C1 overlies side wall C3 and side wall C4 overlies bottom panel C2. The top and bottom panels both are formed with registering bottle neck receiving apertures and an example of such a carton is disclosed in GB-A-2 154 197. The tips of the carton opening fingers enter the carton C through the neck receiving apertures and by engagement with side wall C4 erects the carton into a more set-up condition. The upper extremity of slot 32 has moved closer to the shaft 40 by movement of unit 34 from the FIG. 1 to the FIG. 2 position.

Figure 3A:
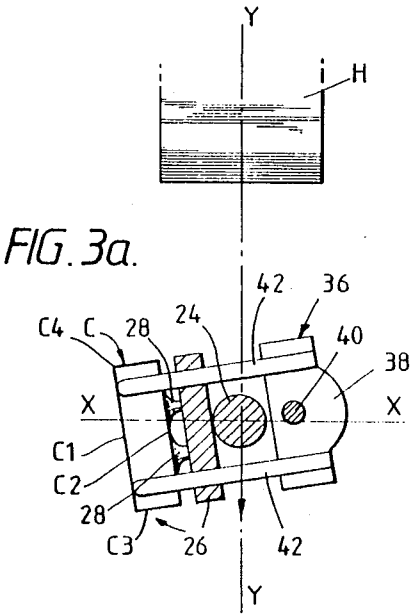
Figure 3:
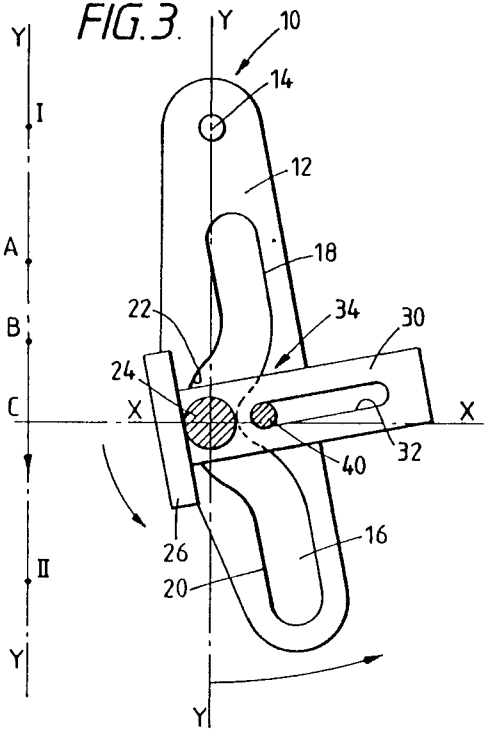

In FIGS. 3 and 3*a* (Phase C), the arm 12, unit 34 and device 36 all are rotationally displaced relative to the attitudes which they had before. At this stage, shaft 24 has reached the mid-position in the curvilinear portion 22 of cam track 16 and because it is contrained to move vertically along axis 'Y—Y', consequently has caused pivotal movement of arm 12 about shaft 14. Shaft 24 is aligned with shaft 40 along axis X—X and the upper extremity of slot 32 has been brought into abutment with shaft 40. Furtherdownward movement of shaft 24 with the arm pivotally displaced out of the Y—Y axis causes unit 34 to pivot about shaft 40 and likewise causes device 36 to pivot about shaft 40 by virtue of the coupling of the unit and the device provided by the engagement of the fingers 42 in the plate apertures 44.

As shaft 24 passes through the curvilinear portion of the cam track, arm 12 is reverse pivoted back to its vertical position along axis Y—Y by which time unit 34 and device 36 together with carton 'c' have been inverted through 180° thereby bringing the carton into a position for application onto the necks of a group of bottles 'B' accommodated within a crate CT. This position is shown in FIGS. 4 and 4a (Phase D). In order to ensure that the carton is 'square' immediately prior to being applied to the bottle group, a static bar 46 is disposed at a location in which it abuts side wall C4 of the carton as unit 34 together with device 36 pivot into their fully inverted position. At this instant, the lowermost end of slot 32 (previously the upper end) is engaged with the shaft 40 and therefore unit 34 is able to move downwardly relative to device 36 as shaft 24 is displaced along the lower linear portion 20 of the cam track whereby unit 34 is uncoupled from device 36.

FIGS. 5 and 5*a* (Phase E) show the shaft at its lowest extremity within the cam track and thus unit 34 in its lowermost position. The uppermost end of slot 32 is now engaged with shaft 40 whereby the fingers 42 have withdrawn from transverse plate 26 and the carton C so that unit 34 and device 36 are detached from one another. As the fingers of device 36 are withdrawn, the final downward motion of unit 34 causes the carton C to be applied onto the necks of the bottles B within crate CT as shown in FIG. 5*a*.

This cycle of operations is then repeated as shaft 24 is again caused to move upwardly. The machine M shown in FIG. 6 is designed to apply cartons to a crate load of bottles in a single operation with a continuous crate feed. To this end, the applicator head assembly A of the machine incorporates a pair of mechanism 10*a*, 10*b* as described above but in which the mechanisms are in back to back relationship and work in synchronisation by virtue of the common actuating ram 31. Each mechanism has three sets of carton transfer units 34 and likewise three sets of cooperating carton manipulating devices 36 all mounted on common shafts 24 and 40. Each set is adapted to apply a carton C to a group of four bottles so that both mechanisms simultaneously apply six cartons to twenty-four bottles, thereby handling a crate load of bottles in one operation. Of course, the requisite number of carton supply hoppers H are provided in the applicator head assembly A. Crates CT enter the machine at an infeed station 48 whereafter they are transferred through 90° into a moving feed path F passing below the applicator head of the machine. Each crate momentarily is stopped for the application of the cartons and is then moved on again transferred through 90° and leaves through an outfeed station 50.

I claim:

1. A mechanism for applying a top-gripping type article carrier carton onto the tops of a group of articles, such as bottles, which mechanism comprises:

a carton transfer unit for withdrawing a carton from an overhead supply along a linear path, transferring the carton from said supply to a position of application, and applying the carton along said linear path onto the group of articles;

a carton manipulating device for cooperating with said carton transfer unit during transfer to at least partially erect the carton; and means for pivoting said carton transfer unit and said carton manipulating device through 180° during said transfer so that the carton is presented in an inverted attitude at said position of application.

2. A mechanism according to claim 1, further characterized in that said carton manipulating device includes carton opening means which cooperates with said carton transfer unit to couple said unit and said device and thereby to erect the carton at least partially during said transfer.

3. A mechanism according to claim 2, further characterized in that said carton opening means comprises a plurality of fingers which enter cooperating apertures provided in the carton transfer unit and in a carton withdrawn by said unit from the supply during said transfer, said fingers also providing the means by which said transfer unit and said manipulating device are coupled together during inversion of said carton.

4. A mechanism according to claim 3, further characterized in that means are provided adjacent said position of application for cooperation with a transferred carton as it is presented in said inverted attitude in order to ensure that the carton is square prior to being applied to said bottle group.

5. A mechanism according to claim 1, further characterized in that said carton transfer unit is constrained to move in a substantially vertical path during transfer from the overhead carton supply to the position of application and in that said carton manipulating device is pivotal about an axis normal to said vertical path and disposed intermediate the path of movement of said carton transfer unit, said transfer unit and said manipulating device being interconnected such that they are pivoted together by said pivoting means during transfer movement of the carton transfer unit along said vertical path so that they are inverted thereby to effect inversion of the carton during transfer.

6. A mechanism according to claim 4, further characterized in that said pivoting means comprises a cam track provided by a pivotal arm which track receives follower means provided by said carton transfer unit, the interconnection between the carton transfer unit and the carton manipulating device being such as to allow said inversion of said transfer unit and said manipulating device together as said follower means moves along said cam track.

7. A method for applying a top gripping type article carrier onto the tops of a group of articles, such as bottles, which method comprises the steps of:

withdrawing a carton from an overhead supply along a linear path;

transferring the carton from said supply to a position of application;

applying the carton along said linear path onto the group of articles;

manipulating the carton during said transferring to at least partially erect the carton; and inverting the carton through 180° during said transferring so that the carton is presented in an inverted attitude at said position of application.

8. A method according to claim 7, further characterized in that said transferred carrier is substantially opened prior to being inverted and is further manipulated after being inverted in order to ensure that the carrier is presented square for application to said bottle group.

* * * * *